US006431892B1

(12) United States Patent
Shupe et al.

(10) Patent No.: US 6,431,892 B1
(45) **Date of Patent: *Aug. 13, 2002**

(54) ELECTRICAL CONNECTOR WITH AUTOMATIC SWITCHING BETWEEN MULTIPLE DEVICES

(75) Inventors: Allen E. Shupe, Sandy; Carl Ketcham, Taylorsville, both of UT (US)

(73) Assignee: 3Com Corporation, Salt Lake City, UT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 24 days.

(21) Appl. No.: 09/655,506

(22) Filed: Sep. 5, 2000

Related U.S. Application Data

(62) Division of application No. 09/387,218, filed on Aug. 13, 1999.

(51) Int. Cl.[7] ..... H01R 29/00
(52) U.S. Cl. ..... 439/188; 439/955
(58) Field of Search ..... 439/188, 955, 439/170

(56) References Cited

U.S. PATENT DOCUMENTS

| | | | | | |
|---|---|---|---|---|---|
| 4,699,443 | A | * | 10/1987 | Goodrich et al. | 439/188 |
| 5,181,858 | A | * | 1/1993 | Matz et al. | 439/188 |
| 5,513,999 | A | * | 5/1996 | Fry et al. | 439/188 |
| 5,568,610 | A | * | 10/1996 | Brown | 714/48 |
| 5,773,901 | A | * | 6/1998 | Kantner | 307/125 |
| 6,074,256 | A | * | 6/2000 | Arnett | 439/676 |
| 6,079,996 | A | * | 6/2000 | Arnett | 439/188 |
| 6,139,342 | A | * | 10/2000 | Thompson | 439/188 |
| 6,168,472 | B1 | * | 1/2001 | Arnett | 439/676 |

* cited by examiner

*Primary Examiner*—Brian Sircus
*Assistant Examiner*—Brian S. Webb
(74) *Attorney, Agent, or Firm*—Kirton & McConkie; Michael F. Krieger

(57) ABSTRACT

The present invention relates to an electrical connector for connecting combination electronic apparatus, which comprise a plurality of internal electronic devices, to networks or other devices. The connector of the present invention comprises a novel switching mechanism which selects between the plurality of internal electronic devices based on the attributes of the mating connector received by the connector. Device selection may be controlled by the physical characteristics of the mating connector, the electrical characteristics of the device or network attached to the mating connector or some other distinct attribute.

18 Claims, 6 Drawing Sheets

ELECTRICAL CONNECTOR WITH AUTOMATIC SWITCHING BETWEEN MULTIPLE DEVICES

RELATED APPLICATION

This application is a divisional application of U.S. Pat. application Ser. No. 09/387,218, filed Aug. 31, 1999 entitled "Electrical Connection with Automatic Switching Between Multiple Devices." The subject matter of application Ser. No. 09/387,218 is hereby incorporated by reference.

BACKGROUND OF THE INVENTION

1. The Field of the Invention

The present invention relates to physical/electrical media connectors used in the computer and communications industry. More particularly, the present invention relates to a physical/electrical media connector used for connecting a computer communications device to a communications network such as a computer network or a telephone system. The apparatus of the present invention is a physical/electrical media connector which can accommodate a plurality of physically and electrically distinct connector types and distinguish between these types thereby allowing for internal modification of a host device to adapt to the electrical characteristics of the specific connector.

2. The Relevant Technology

Electronics connectors in the computer and communications industry are available for a wide array of applications from communications and data transfer applications to power connections. Due to the pace of technology in this area and the trend toward smaller, more efficient and more capable hardware, connectors evolve on an almost daily basis. A plethora of standards have evolved for specific connector and hardware applications, however proprietary connectors proliferate throughout the industry. Some standards in the media connector industry have been imposed by government regulation such as the Federal Communications Commission's Title 47, § 68.500, otherwise denoted "Subpart F-Connectors" (Subpart F). Subpart F contains detailed specifications for "miniature" connectors used in the communications industry. Included in this specification are the "Miniature 6-position plug and jack" and the "Miniature 8-position plug and jack." These connectors, commonly known as the RJ-11 connector and the RJ-45 connector respectively, are ubiquitous throughout the industry.

The miniature 6-position connector or RJ-11 connector, as shown in FIGS. 1A–1D, comprises a plug 2 and a jack 4 for receiving the plug 2. The plug 2, as shown in FIGS. 1A & 1B, comprises a rectangular connector block 6 containing positions for 6 electrical conductors. The plug is usually corded 8 with the cord's conductors 10 terminating in plug block 6 in a manner that allows contact with jack conductors 16 in jack 4. In many telephone applications, the connector will have only 2 or 4 conductors despite its 6 position capacity. The specified plug block width 12 of the 6-position plug is 0.380" or 9.6520 mm. while the 6-position plug block's specified height 14 is 0.26" or 6.604 mm. 6-position plug block 6 also comprises an alignment rib 18 which corresponds with a complementary groove 20 in jack 4. A locking tang 22 protrudes from alignment rib 18 and selectively engages stops 24 on jack 4.

The miniature 8-position connector or RJ-45 connector also comprises a plug 32 and a jack 34 for receiving plug 32. The 8-position plug 32 also comprises an alignment rib 36, and a locking tang 38 and is very similar to the 6-position plug 2 except for the fact that it's capacity allows for the use of 8 conductors and the width 40 of the 8-position plug block is slightly larger. The 8-position plug block has a width of 0.46" or 11.684 mm.

The FCC's Subpart F provides specifications for both 6-position and 8-position jacks for receiving their respective plugs, however the 8-position connector jack 34 will accommodate both the 6-position 2 and 8-position plugs 32. The alignment ribs of both plugs are configured to work with the 8-position jack groove 42 to ensure that conductors align properly even when the plug block is smaller than the jack opening. This feature allows for the use of the 6-position plug in an 8-position jack without misalignment of conductors.

The miniature 6-position connector or RJ-11 has emerged as the industry standard connector for telephone lines. RJ-11 plugs and jacks are used on almost all telephone sets for connection to the phone system and consequently are used for standard modem connections which also use these telephone lines. Although most telephone companies use only 4 or 2 of the available positions on the connector, the 6-position connector is the standard.

The miniature 8-position connector or RJ-45 has emerged as the industry standard connector for computer networks. It is used for interconnectivity between network adapter cards, hubs, routers, switches and other network hardware.

These connectors have been the industry standard for many years and are likely to remain so in the future for telephones, desktop computer modems and network adapters, and other substantially stationary communications equipment. However, hardware technology and the "miniaturization" of components has progressed to the point that the standard, "miniature" RJ connectors are bigger than the thickness of the hardware to which they connect.

An example of these smaller hardware configurations is the PC Card Standard promulgated by the Personal Computer Memory Card International Association (PCMCIA). The PCMCIA PC Card standard identifies three primary card types: Type I, II and III. These types correspond to physical dimension restrictions of 85.6 mm (length)×54.0 mm (width) and thicknesses of 3.3 mm, 5.0 mm and 10.5 mm respectively. These cards are used to expand the functionality of computers and related products by adding circuitry contained on the card to the host device. Host devices, such as laptop computers, contain expansion slots which receive the expansion cards and provide electrical connections thereto.

As a consequence of hardware miniaturization in the face of a nearly worldwide RJ connector standard, hardware manufacturers have developed myriad proprietary hardware connection standards and an assortment of connectors and adapters that allow the RJ plugs to be connected to small profile hardware.

One such adapter is shown in FIG. 5 where an adapter cable connector or "podule" 6 for a PCMCIA ethernet adapter is shown. The narrow profile connector 4 on the end of the adapter cable that connects to the PC Card is shown. The other end of the adapter cable comprises a larger profile receptacle which receives a standard RJ plug. This type of adapter is also known as a "dongle" after the way it dangles out of the computer card. A typical PC Card socket 110 to which the dongle attaches is shown in FIG. 3.

Another, more convenient, connector which allows connection of the standard RJ type plug with narrow profile hardware is the XJACK® produced by 3Com Corporation, Salt Lake City, Utah. The XJACK®, shown generally in FIG. 6, is a narrow profile connector designed to be contained within hardware such as PC Card standard compliant devices. The XJACK® comprises a thin body 60 with an aperture 62 therein for receiving a standard RJ connector plug 64 or some other connector. Jack conductors 66 contact plug conductors 68 just as a conventional RJ jack connects. The XJACK® may be retractable within the device or be detachable therefrom.

As technology increases and electronic devices become more compact, more and more devices are being combined in one device. A single PC Card may now contain multiple devices which may require a plurality of connections to external devices. One example is the now common "combo card" which combines a modem with a network adapter. This card, usually used in a compact computer, allows for direct connection to a computer network as well as connection to a phone line through the modem circuitry. The standard connectors used for these connections are the RJ-45 and the RJ-11 respectively. Dongle type connectors may be used on these combo cards with separate proprietary connectors on the card for connection to telephone or computer networks, however, dongles are often inconvenient and can be easily lost or damaged.

The XJACK® is an ideal connection jack for PC Card format combo cards due to its narrow profile, but the XJACK® uses valuable space on the card for its convenient retractable connector jack. This means that the XJACK® uses PC board space that might otherwise be used for circuitry or other card components. When one XJACK® is used, sufficient space remains on the board for the required circuitry, however, when two connectors are needed, the use of multiple XJACK's is virtually prohibited as too much board space would be monopolized by the retractable connectors.

XJACK's, dongles and other jacks which receive the 6- and 8-position plugs may be physically configured to receive both the 6- and the 8-position plug and to properly align the electrical connectors contained therein, however, variations in the electrical requirements for modems and network adapters prevents the use of one permanently wired jack for both applications. An RJ-11 plug will physically connect with an RJ-45 jack, but the electrical connections effectuated by the connection—phone line to network adapter will not be functional and may damage the network adapter circuitry. The tip-to-ring voltage of a standard phone line is nominally 48 volts and may range between 25 and 75 volts. This is sufficient voltage to permanently damage internal circuitry if connected improperly. Likewise, connecting a computer network cable to a modem will prove futile as the two types of communication networks are vastly different on the electrical level.

Accordingly, what is needed is a single jack which may be both electrically and physically configured to accept both a phone line connection via an RJ-11 plug and a computer network connection via an RJ-45 plug.

SUMMARY AND OBJECTS OF THE INVENTION

The present invention relates to a physical/electrical media connector that is physically and electrically compatible with a plurality of electrically distinct devices. The electrically distinct devices have unique electrical connection requirements that require dissimilar connections at the media connector. Therefore, conductors within the device must be internally switched to route the externally connected circuits to the proper internal circuitry.

Some embodiments of the present invention utilize a mechanical switching device actuated by the physical differences between the various plugs which may be inserted therein. In one embodiment, mechanical cams or levers are located within the connector jack which are actuated only when a physical feature present on a certain plug contacts those cams or levers. When actuated, the cams or levers physically switch between alternative sets of internal connectors such that one internal device is connected to the connector as a default, but another internal device is connected to the connector when the certain plug is inserted into the jack. This arrangement allows multiple devices to use the same jack and to be selected simply by connection to a specific plug type.

Other embodiments of the present invention utilize an electronic switching device such as a multiplexor to effectuate the switching of internal circuitry in order to connect to a specific internal device. The electrical switching device may be actuated by a physical feature of the connector plug such as the plug size or a protruding tab or it may be actuated by an electrical contact on the plug. The electrical switching device may also be actuated by the electrical characteristics of the conductors in the plug and the device to which the plug is attached. For example, and not by way of limitation, the impedance measured through one or more of the conductors on the plug or the voltage level on or across one or more of the conductors on the plug can trigger the switching device and connect to a specific internal device.

Accordingly, it is an object of some embodiments of the present invention to provide a single connector that provides a connection to multiple electrically distinct devices with different connectivity requirements.

It is also an object of some embodiments of the present invention to provide a single connector that will connect to a plurality of physically distinct, mating connectors.

These and other objects and features of the present invention will become more fully apparent from the following, description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The figures listed above are expressly incorporated as part of this detailed description.

It will be readily understood that the components of the present invention, as generally described and illustrated in the Figures herein, could be arranged and designed in a wide variety of different configurations. Thus, the following more detailed description of the embodiments of the system and apparatus of the present invention, as represented in FIGS. 1A through 9, is not intended to limit the scope of the invention, as claimed, but it is merely representative of the presently preferred embodiments of the invention.

The currently preferred embodiments of the present invention will be best understood by reference to the drawings, wherein like parts are designated by like numerals throughout.

The Personal Computer Memory Card International Association (PCMCIA) promulgates the PC Card Standard for narrow profile or thin architecture expansion cards for electronic devices. The PC Card standard designates the physical dimensions of the cards as well as the electrical configuration of the cards including the 68-pin interface between the card and the host device. The physical dimensions of cards conforming to this standard are 85.6 mm in length by 54.0 mm in width. Several thickness variations fall within the standard and are designated by type number. Type I, II, and III PC Cards have thicknesses of 3.3 mm, 5.0 mm and 10.5 mm respectively. Any references to the PC Card Standard or PCMCIA card standard refer to electronic cards substantially conforming to this standard as described herein.

The term miniature modular jack, physical/electrical media connector, fixed jack, XJACK, alligator jack, and the like, connotes a media connector that may have qualities such as those connectors having physical attributes described in F.C.C. Part 68, Subpart F. Specific terms such as RJ-type, RJ-11, RJ-45, 6-pin miniature modular plug, 8-pin miniature modular plug, and similar terminology are all references to specific exemplary physical/electrical media connectors falling within the broader parameters of the term physical/electrical media connectors and are cited by way of example and should not be used to limit the scope of the present invention to specific connectors.

Figure 1A:
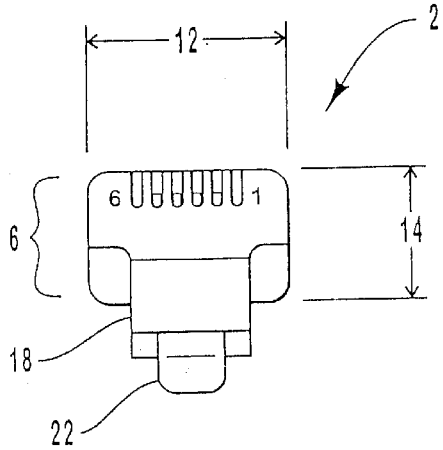
FIG. 1A (PRIOR ART)
FIG. 1A is an end view of a miniature 6-position plug or RJ-11 plug.
Figure 1B:
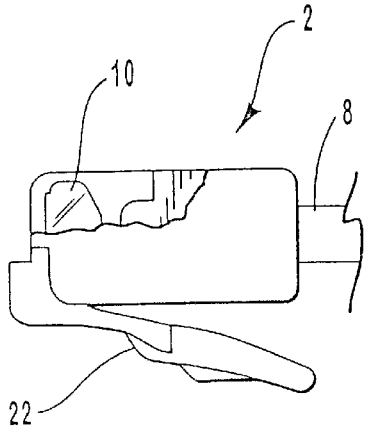
FIG. 1B (PRIOR ART)
FIG. 1B is a side view of a miniature 6-position plug or RJ-11 plug.
Figure 2A:
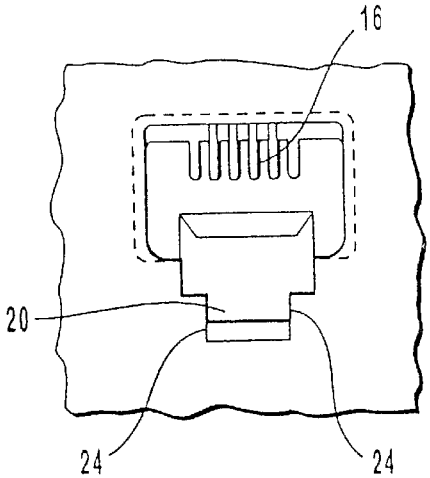
FIG. 2A (PRIOR ART)
FIG. 2A is an end view of a miniature 6-position jack or RJ-11 jack.
Figure 2B:
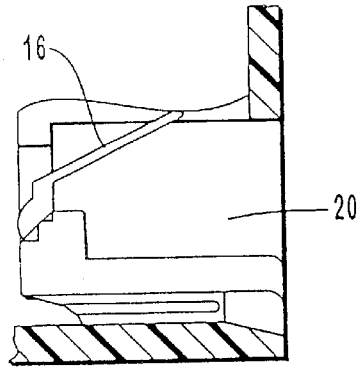
FIG. 2B (PRIOR ART)
FIG. 2B is a side view of a miniature 6-position jack or RJ-11 jack.
Figure 3A:
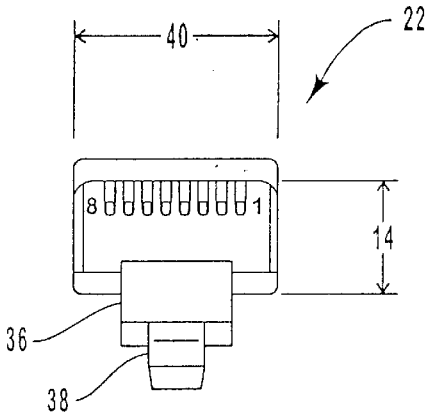
FIG. 3A (PRIOR ART)
FIG. 3A is an end view of a miniature 8-position plug or RJ-45 plug.
Figure 3B:
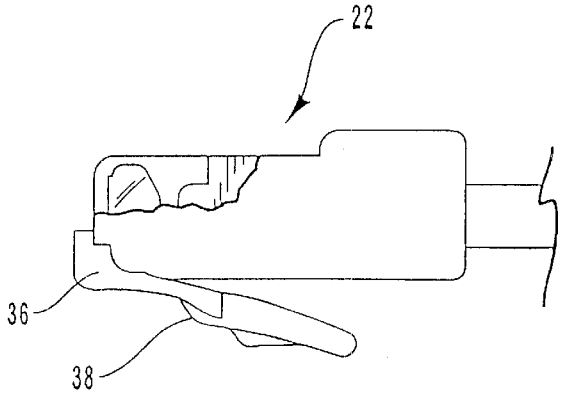
FIG. 3B (PRIOR ART)
FIG. 3B is a side view of a miniature 8-position plug or RJ-45 plug.
Figure 4A:
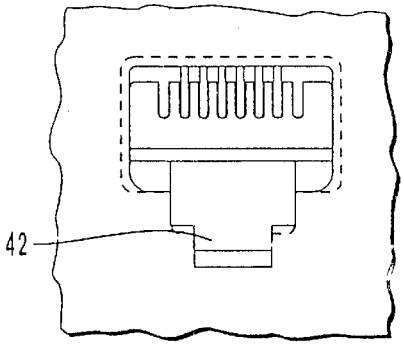
FIG. 4A (PRIOR ART)
FIG. 4A is an end view of a miniature 8-position jack or RJ-11 jack.
Figure 4B:
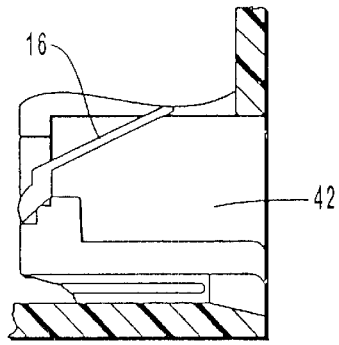
FIG. 4B (PRIOR ART)
FIG. 4B is a side view of a miniature 8-position jack or RJ-11 jack.
Figure 5:
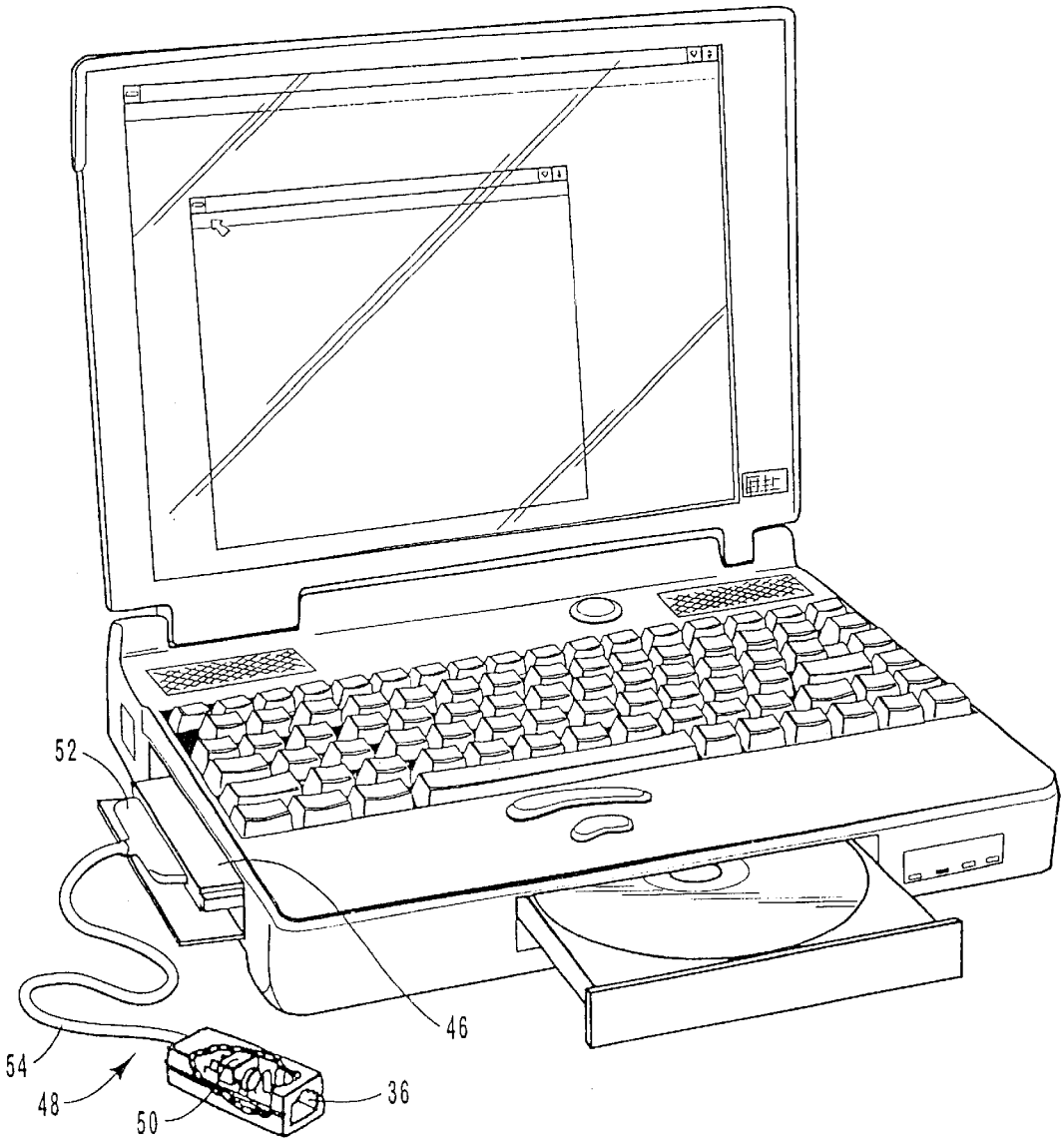
FIG. 5 is a perspective view of a prior art "dongle" type connector.
Figure 6:
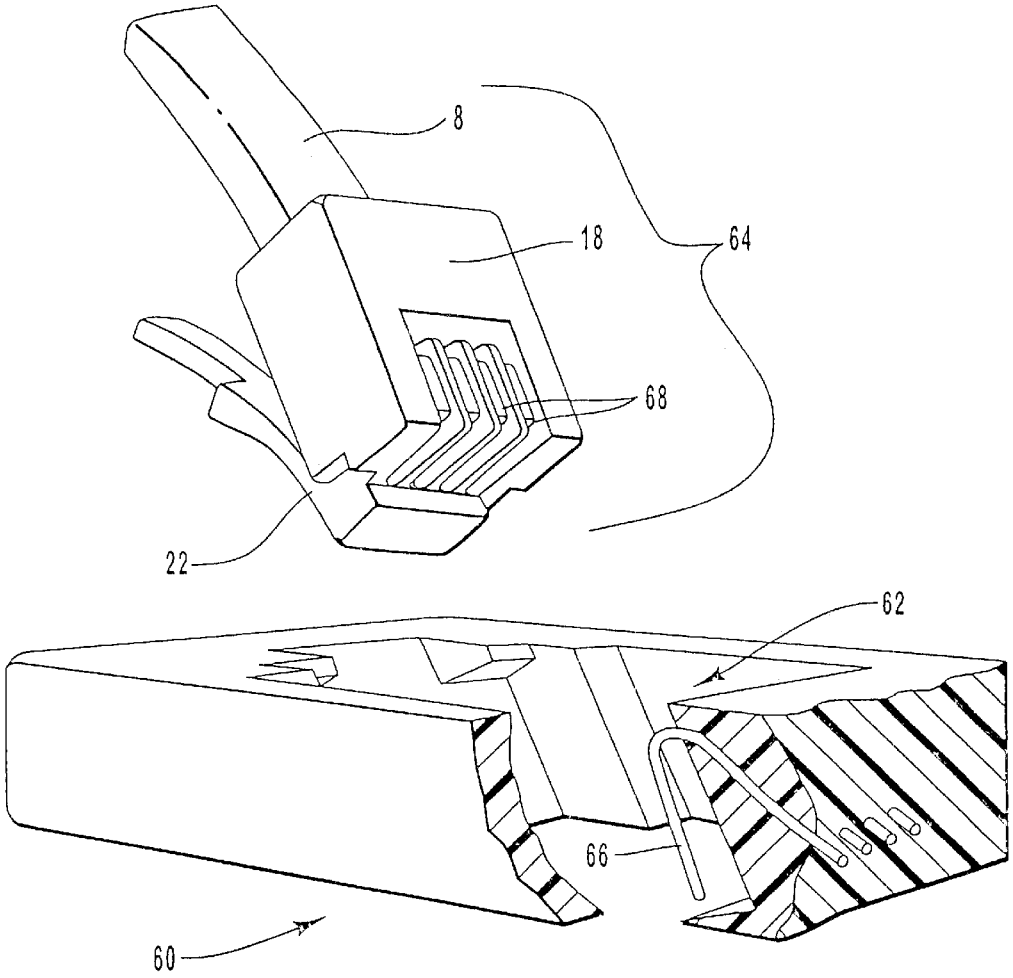
FIG. 6 is a perspective view of a thin profile, "XJACK" type connector with its associated RJ-11 type plug.
Figure 7:
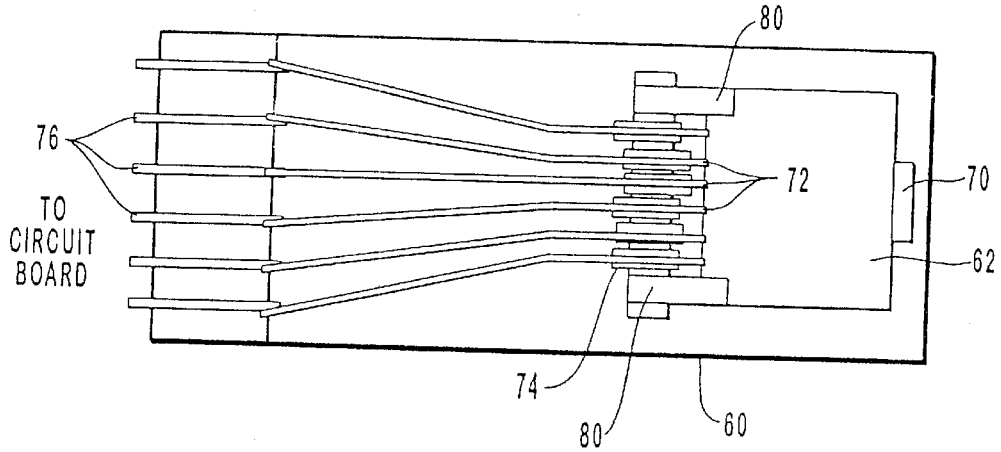
FIG. 7 is a top cross-sectional view of one embodiment of the present invention showing a mechanical switching mechanism therein.

In reference to FIG. 7, a first embodiment of the present invention is shown in cross-sectional plan view. This particular embodiment employs a narrow profile connector jack such as an XJACK® with a narrow body 60 having an aperture 62 therein for receiving a physical/electrical media plug 64 such as a standard 6-position or 8-position miniature plug. This particular embodiment further comprises jack contacts 72 which are aligned so that they will contact plug contacts 68 when plug 64 is inserted into aperture 62. Jack contacts 72 extend over a mechanical switching means such as a cam mechanism 74 and terminate in a position proximate to fixed device contacts 76 such that cam mechanism 74 can be selectively actuated to move jack contacts 72 into electrical communication with fixed device contacts 76 thereby forming an electrical connection between plug contacts 68 and fixed device contacts 76 or to move jack contacts 72 out of electrical communication with fixed device contacts 76 thereby disallowing an electrical connection between fixed device contacts 76 and plug contacts 68. Cam mechanism 74 can be configured to selectively connect or disconnect combinations of contacts depending on its orientation.

In an alternative embodiment of the mechanical switching means, cam mechanism 74 may switch jack contacts 72 between multiple sets of fixed device contacts 76 & 78. This allows multiple devices to utilize the same jack contact position.

Figure 8:
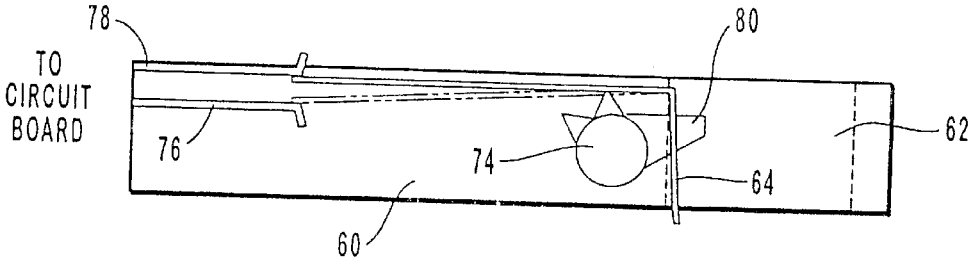
FIG. 8 is a side cross-sectional view of the embodiment of the present invention depicted in FIG. 7
Figure 9:
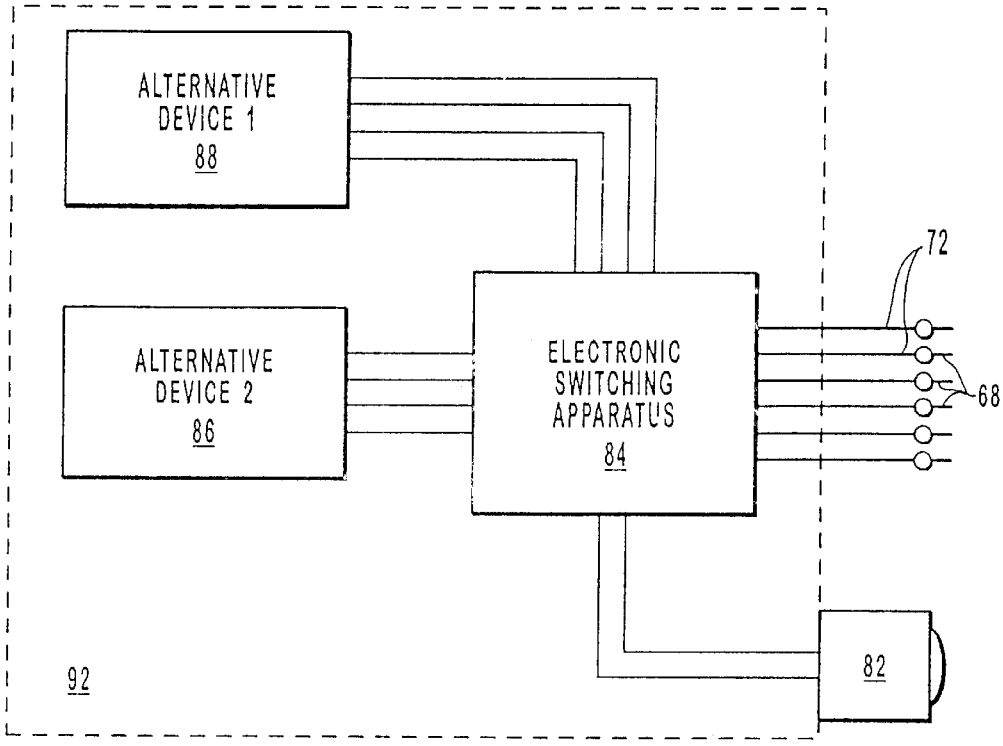
FIG. 9 is a hardware diagram showing an embodiment of the present invention which employs electronic switching means.

In an embodiment configured to alternately receive a miniature 6-position plug or a miniature 8-position plug, as shown in FIG. 7 & 8, cam levers 80 of the mechanical switching means are spaced apart at a distance which allows the miniature 6-position plug to pass between cam levers 80 without rotating cam mechanism 74. Therefore, cords and devices which connect to jack 60 using a miniature 6-position plug will connect to a first set of fixed device contacts 76. However, cam levers 80 are not spaced apart a sufficient distance to allow a miniature 8-position plug to pass therebetween. When a miniature 8-position plug is inserted into jack 60, cam levers 80 are forced downward thereby rotating cam mechanism 74 and selecting a second set of fixed device contacts 78. Therefore, devices and cords which connect to jack 60 with a miniature 8-position plug will connect to second fixed device contacts 78 and the alternative electronic device connected thereto.

In this manner, jack 60 may be used to connect to multiple, alternative electronic devices. A combination modem and network adapter may utilize an embodiment of the present invention to connect a miniature 6-position plug to the modem or to alternatively connect a miniature 8-position plug to the network adapter. This alternative use is ideal as very few combo card users utilize both modem and network adapter at the same time. When a user requires simultaneous use of both devices alternative connections with dongles or other cords and connectors may be incorporated into the combination device.

Cam mechanism 74 may be spring loaded or otherwise configured so as to rest only in appropriate switching positions. Cam mechanism 74 is just one embodiment of the mechanical switching means of the present invention. Alternative embodiments may comprise levers, switches, shafts, rods and any other mechanical elements which effectuate the purpose of cam mechanism 74.

A further embodiment of the present invention utilizes an electrical switching means to switch between multiple electronic devices. In reference to FIG. 9, plug contacts 68 may connect to jack contacts 72 thereby connecting combination electronic device 92, such as a combo card, to a telephone or network. When the jack connection is made, the position of the plug will actuate physically actuated switch 82 which will signal to electronic switching apparatus 84 which alternative device to connect. Physically actuated switch 82 may be a lever or button switch which is triggered by a physical feature of an inserted plug such as the increased width of a miniature 8-position plug relative to a miniature 6-position plug. Physically switch 82 may also incorporate electronic sensors such as photoelectric cells, piezoelectric sensors or other sensing means which can differentiate between alternative physical plug characteristics.

As a non-limiting example of physically actuated switch 82, a lever, such as lever 80 in cam mechanism 74 may trigger an electric circuit which indicates to electronic switching apparatus 84 that a miniature 8-position plug has been connected. Electronic switching apparatus 84 will then connect to the appropriate alternative device 86, 88 for that connection. In the case of a typical combo card, the network adapter would be connected when an 8-position plug is inserted and the modem would be connected when a 6-position plug is inserted.

Electronic switching apparatus 84 may include several embodiments including, but not limited to, a multiplexer switch or relay.

Figure 10:
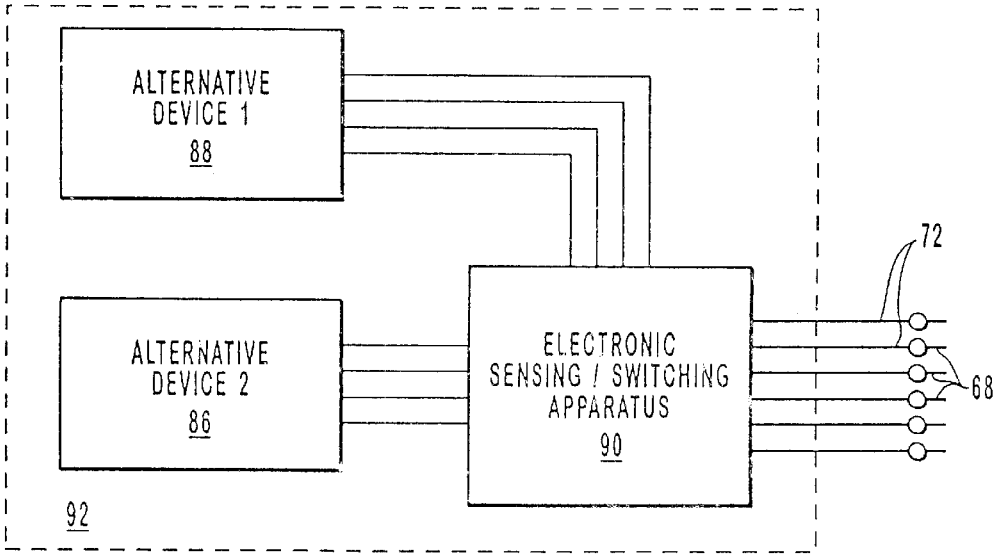
FIG. 10 is a hardware diagram showing an alternative embodiment of the present invention employing an electronic switching means.

Another embodiment of the present invention, as shown in FIG. 10, avoids the use of physically actuated switches or mechanical switches through the use of electronic sensors which identify the type of external device connected to the jack contacts 72 by the electrical characteristics of the external device. For example, and not by way of limitation, the voltage between contacts may be used to indicate what type of external device is connected. The tip-to-ring voltage on a telephone line typically has a nominal value of 48 volts and may vary between 25 to 75 volts D.C. The electronic switching apparatus may be combined with sensing circuitry to form an electronic sensing/switching apparatus 90 which may be configured to detect this voltage level and switch the contacts to the modem which would be used with this telephone line. When a tip-to-ring voltage level is not detected the electronic switching apparatus 84 would switch to the network adapter or some other alternative device.

Alternatively, the electronic sensing\switching apparatus 90 may be configured to measure a characteristic impedance level between fixed contacts. A low DC impedance on some contacts may indicate the presence of a transformer or other electronic device used with a computer network. This low DC impedance level can be used to indicate to the sensing\switching apparatus 90 that a computer network has been connected to the jack and that the internal network adapter should be connected as the alternative device in the combo card.

While voltage and impedance levels are noted as indicators of a specific type of external electronic device connected to the jack of an embodiment of the present invention these electrical attributes are given by way of example and not by limitation. Other characteristics may also be used to identify connected hardware and are to be held within the scope of the electronic sensing\switching apparatus of the present invention.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

We claim:

1. A combination electronic device comprising:

a physical/electrical media connector jack contained within a thin profile device, wherein said media connector jack is a retractable jack; and an electrical switching apparatus for selectively connecting various types of physical/electrical media connector plugs to said media connector jack, wherein said electrical switching apparatus is configured to utilize an electronic sensor that causes said electrical switching apparatus to move from a first contact position to a second contact position by sensing a physical characteristic and an electrical characteristic of said media connector plug that is introduced into said media connector jack, and wherein said first contact position corresponds to a connection of a first type of media connector plug and said second position corresponds to a connection of a second type of media connector plug.

2. A combination electrical device as recited in claim 1, wherein said electronic sensor is configured to sense a voltage level between contacts on said media connector plug.

3. A combination electrical device as recited in claim 1, wherein said electronic sensor is configured to sense an impedance level between contacts on said media connector plug.

4. A combination electrical device as recited in claim 1, wherein said electrical switching apparatus comprises a multiplexor.

5. A combination electrical device as recited in claim 1, wherein said characteristic of said media connector plug that is introduced into said media connector jack is a size of said media connector plug.

6. A combination electrical device as recited in claim 1, wherein said characteristic of said media connector plug that is introduced into said media connector jack is a tab of said media connector plug.

7. A combination electrical device as recited in claim 1, wherein said characteristic of said media connector plug that is introduced into said media connector jack is an electrical contact on said media connector plug.

8. A combination electrical device as recited in claim 1, wherein said characteristic of said media connector plug that is introduced into said media connector jack is an electrical characteristic of said media connector plug.

9. A combination electrical device as recited in claim 8, wherein said electrical characteristic of said media connector plug comprises one of:

(i) an impedance; and (ii) a voltage.

10. A combination electrical device as recited in claim 1, wherein each of said media connector plugs have a device connector therein.

11. In a connecting system that is configured to accommodate a plurality of physically and electrically distinct connector types, a method for distinguishing a type of physical/electrical media connector and selectively switching from a first contact position to a second contact position, the method comprising the steps for:

providing a physical/electrical media connector jack contained within a thin profile device, wherein said media connector jack is configured to be selectively retractable;

selectively connecting an electrical switching apparatus to said media connector jack, wherein said switching apparatus is configured to selectively connect various types of physical/electrical media connector plugs to said media connector using an electronic sensor to sense a physical characteristic and an electrical characteristic of a physical/electrical media plug that is introduced into said media connector jack; and using said switching apparatus to selectively move from a first contact position to a second contact position upon sensing said characteristic of said media connector plug introduced into said media connector jack, wherein said first contact position corresponds to a connection of a first type of media connector plug and said second position corresponds to a connection of a second type of media connector plug.

12. A method as recited in claim 11, wherein said step for using said electronic sensor comprises sensing an electrical contact.

13. A method as recited in claim 12, wherein said step for using said electronic sensor further comprises the step for sensing a voltage.

14. A method as recited in claim 12, wherein said step for using said electronic sensor further comprises the step for sensing an impedance.

15. A method as recited in claim 11, wherein said step for using said electronic sensor comprises the step for sensing a size of said media connector plug.

16. A method as recited in claim 11, wherein said step for using said electronic sensor comprises the step for sensing a tab of said media connector plug.

17. A method for providing an electrical switching mechanism in a connecting system that is configured to accommodate a plurality of physically and electrically distinct connector types, the method comprising the steps for:

providing a physical/electrical media connector jack that is selectively retractable and is contained within a thin profile device;

selectively connecting a multiplexor to said media connector jack, wherein said multiplexor is configured to selectively connect various types of physical/electrical media connector plugs to said media connector jack;

using an electronic sensor to sense a physical characteristic and an electrical characteristic of a physical/electrical media plug that is introduced into said media connector jack; and using said multiplexor to selectively switch from a first contact position to a second contact position upon sensing said characteristic of said media connector plug introduced into said media connector jack, wherein said first contact position corresponds to a connection of a first type of media connector plug and said second position corresponds to a connection of a second type of media connector plug.

18. A method as recited in claim 17, wherein said step for using said electronic sensor comprises at least one of the steps for:

(i) sensing a voltage;

(ii) sensing an impedance;

(iii) sensing a size of said media connector plug; and (iv) sensing a tab of said media connector plug.

* * * * *